US009283647B2

(12) United States Patent
Tomita et al.

(10) Patent No.: US 9,283,647 B2
(45) Date of Patent: Mar. 15, 2016

(54) CENTRIFUGAL BARREL POLISHING MACHINE AND CENTRIFUGAL BARREL POLISHING METHOD

(71) Applicant: TIPTON CORP., Nagoya-shi, Aichi (JP)

(72) Inventors: Yoshiyuki Tomita, Nagoya (JP); Tomoyuki Kobayashi, Nagoya (JP)

(73) Assignee: TIPTON CORP., Nagoya-Shi, Aichi (JP)

( * ) Notice: Subject to any disclaimer, the term of this patent is extended or adjusted under 35 U.S.C. 154(b) by 0 days.

(21) Appl. No.: 14/378,097

(22) PCT Filed: Feb. 18, 2013

(86) PCT No.: PCT/JP2013/053882

§ 371 (c)(1),
(2) Date: Aug. 11, 2014

(87) PCT Pub. No.: WO2013/125491

PCT Pub. Date: Aug. 29, 2013

(65) Prior Publication Data

US 2015/0038054 A1 Feb. 5, 2015

(30) Foreign Application Priority Data

Feb. 22, 2012 (JP) ..... 2012-036794

(51) Int. Cl.
*B24B 31/033* (2006.01)
*B24B 31/02* (2006.01)

(52) U.S. Cl.
CPC ..... *B24B 31/033* (2013.01); *B24B 31/0212* (2013.01); *B24B 31/0218* (2013.01)

(58) Field of Classification Search
CPC ..... B24B 31/033; B24B 31/0218; B24B 31/0212
See application file for complete search history.

(56) References Cited

U.S. PATENT DOCUMENTS 3,513,604 A 5/1970 Matsunaga et al.
3,823,512 A * 7/1974 Kobayashi ..... 451/329

(Continued)

FOREIGN PATENT DOCUMENTS

JP 45-29359 B 9/1970
JP 48-74391 U 9/1973

(Continued)

OTHER PUBLICATIONS

International Search Report for Application No. PCT/JP2013/053882 mailed Mar. 12, 2013 (in English and Japanese).

*Primary Examiner* — Dung Van Nguyen
(74) *Attorney, Agent, or Firm* — Smith, Gambrell & Russell, LLP

(57) ABSTRACT

A centrifugal barrel polishing machine includes a barrel which is configured to perform planetary rotation and into which workpieces and ceramic polishing media are put, thereby polishing the workpieces by the polishing media. A relative centrifugal acceleration F during the planetary rotation of the barrel is set in a range of $2.1(n/N)+29.5 \leq F \leq 6.1(n/N)+40.7$ where N designates a revolution speed of the barrel, n designates a rotation speed of the barrel, R designates a radius of an orbital path drawn by a rotation center of the barrel, n/N designates a rotation/revolution ratio of the barrel, and $F=4\pi^2N^2R/g$ designates a relative centrifugal acceleration which is a ratio of a centrifugal acceleration on the orbital path during the planetary rotation of the barrel to gravity acceleration g.

5 Claims, 3 Drawing Sheets

(56) References Cited

U.S. PATENT DOCUMENTS

| | | | | |
|---|---|---|---|---|
| 4,638,600 | A * | 1/1987 | Kobayashi et al. | 451/329 |
| 5,454,749 | A * | 10/1995 | Ohno | 451/329 |
| 6,367,134 | B1 * | 4/2002 | Sanada et al. | 29/25.42 |
| 6,945,852 | B2 * | 9/2005 | Bagdasarian | 451/32 |
| 2002/0013125 | A1 * | 1/2002 | Fujishiro | 451/326 |

FOREIGN PATENT DOCUMENTS

| | | | |
|---|---|---|---|
| JP | 2-190255 | A | 7/1990 |
| JP | 2000-108014 | A | 4/2000 |
| JP | 2008-142877 | A | 6/2008 |
| JP | 2009-166226 | A | 7/2009 |

* cited by examiner

CENTRIFUGAL BARREL POLISHING MACHINE AND CENTRIFUGAL BARREL POLISHING METHOD

TECHNICAL FIELD

The present invention relates to a centrifugal barrel polishing machine and a centrifugal barrel polishing method.

BACKGROUND ART

A centrifugal barrel polishing machine includes one or more barrels which are rotated in a planetary manner and into which are put workpieces and abrasive media (water, compounds and the like are added if necessary). The workpieces are abraded by the abrasive media in a manner of relative movement difference between the workpieces and the abrasive media resulting from a centrifugal force. Active research has been conducted on improvement in a work polishing amount per unit time (polishing speed) in a polishing machine using the centrifugal force. Patent Document 1 discloses a technique of increasing a polishing amount from the point of structural parameter.

Symbol "R" designates a revolution radius of a barrel. Symbol "r" designates a radius of the barrel. Symbol "N" designates a revolution speed of the barrel per second. Symbol "n" designates a rotation speed of the barrel per second. Patent Document 1 discloses that a polishing amount is increased and a time required for the polishing is shortened when a ratio of a rotation speed to a revolution speed (n/N) is set to about $-3.4 \leq n/N \leq -1$ under the condition that a ratio of a revolution radius to a rotation radius (R/r) is ranged as $1.5 \leq R/r \leq 8$.

Patent Document 1 further discloses that the structure is simple and the manufacturing cost can be reduced when $n/N=-1$ and that this case is preferable as compared a case where $-1<n/N<0$ in which the structure is complicated and the efficiency is low. The effects disclosed by Patent Document 1 are actually accepted widely. Many of generally manufactured centrifugal barrel polishing machines have been designed on the basis of $n/N=-1$ for about 40 years since Patent Document 1 was published.

PRIOR ART DOCUMENT

Patent Documents

Patent Document 1: Japanese Examined Patent Application Publication No. JP-B-S45-29359

SUMMARY OF THE INVENTION

Problem to be Overcome by the Invention

In the centrifugal barrel polishing machines, polishing media which are brought into direct contact with workpieces to polish the workpieces are worn more as the workpieces are polished. Accordingly, it has conventionally been a matter of course that a wear amount (a wear rate) of the polishing media is increased more as a polishing amount (a polish rate) of workpieces is increased. In other words, when a ratio of a polishing amount of workpieces per unit time to a wear amount of polishing media per unit time is defined as "polishing efficiency", a view that the polishing efficiency would not vary much even when a polishing amount (a polish rate) is increased or decreased has been the norm in the polishing industry. Aforementioned Patent Document 1 does not refer to the polishing efficiency.

However, users (clients) of centrifugal barrel polishing machines have an increasing demand that a polishing amount (a polish rate) should be improved while a progress in wear of polishing media is suppressed (that is, both polishing amount and polishing efficiency should be improved). The demand can be accounted for in terms of the circumstances that a polishing amount should be improved for pursuit of productivity but that when a wear amount (a wear rate) of the polishing media is increased, not only running costs are increased, but also wear debris mixes with water into sludge, which results in poor working conditions and an increase in drainage treatment burden.

There is a need of realizing a reduction in the production time and a reduction in the wear amount of polishing media by simultaneous improvement of the polishing amount and the polishing efficiency with the result of a reduction in the running costs. Alternatively, there is a need of reducing dangerous, hard and dirty works and promoting the resolution of global environmental problems. These needs have become evident particularly recently with all-industry pursuit of energy saving, high efficiency and corporate social responsibility (CSR).

The present invention was made in view of the foregoing circumstances and an object thereof is to provide a centrifugal barrel polishing machine and a centrifugal barrel polishing method both of which can maintain or improve a polishing efficiency that is a ratio of the polishing amount of workpieces per unit time to the wear amount of polishing media per unit time while increasing the polishing amount of workpieces per unit time.

Means for Overcoming the Problem

A centrifugal barrel polishing machine which includes a barrel which is configured to perform planetary rotation and into which workpieces and ceramic polishing media are put, thereby polishing the workpieces by the polishing media, wherein a relative centrifugal acceleration F during the planetary rotation of the barrel is set in a range of $2.1(n/N)+29.5 \leq F \leq 6.1(n/N)+40.7$ where N designates a revolution speed of the barrel, n designates a rotation speed of the barrel, R designates a radius of an orbital path drawn by a rotation center of the barrel, n/N designates a rotation/revolution ratio of the barrel, and $F=4\pi^2N^2R/g$ designates a relative centrifugal acceleration which is a ratio of a centrifugal acceleration on the orbital path during the planetary rotation of the barrel to gravity acceleration g.

A second invention is a centrifugal barrel polishing method of polishing workpieces by ceramic polishing media by putting the workpieces and the polishing media into a barrel which performs planetary rotation, wherein a relative centrifugal acceleration F during the planetary rotation of the barrel is set in a range of $2.1(n/N)+29.5 \leq F \leq 6.1(n/N)+40.7$ where N designates a revolution speed of the barrel, n designates a rotation speed of the barrel, R designates a radius of an orbital path drawn by a rotation center of the barrel, n/N designates a rotation/revolution ratio of the barrel, and $F=4\pi^2N^2R/g$ designates a relative centrifugal acceleration which is a ratio of a centrifugal acceleration on the orbital path during the planetary rotation of the barrel to gravity acceleration g.

Effect of the Invention

The inventors conducted the following experiment and speculated in order to obtain mechanically structural conditions which can maintain or improve a polishing efficiency that is a ratio of a polishing amount of workpieces per unit time to a wear amount of polishing media per unit time while increasing the polishing amount of workpieces per unit time.

Firstly, in addition to the conventionally known ratio n/N of a rotation speed of the barrel to a revolution speed of the barrel, the inventors focused attention on a relative centrifugal acceleration F that is a ratio of a centrifugal acceleration on an orbital path during the planetary rotation of the barrel to the gravity acceleration. The inventors conducted the experiment, making a prediction that the relative centrifugal acceleration F and the rotation/revolution ratio n/N had significance in the relationship with a polishing amount and a polishing efficiency.

The inventors made a multiple regression analysis based on the experimental results thereby to derive a regression expression with respect to a polishing amount and a polishing efficiency. The regression expression includes the relative centrifugal acceleration F and the rotation/revolution ratio n/N as explanatory variables. The inventors analyzed the relationship between the relative centrifugal acceleration F and the rotation/revolution ratio n/N both obtained based on the regression expression. Consequently, the inventors found that while the polishing amount was increased and the polishing efficiency was reduced as a whole with an increase in the relative centrifugal acceleration F, the relative centrifugal acceleration F, which is suitable to be capable of realizing increasing the polishing amount of workpieces per unit time with maintenance or improvement in the polishing efficiency, is limited to a range of $2.1(n/N)+29.5 \leq F \leq 6.1(n/N)+40.7$, Regarding the range of $F<2.1(n/N)+29.5$, customer needs are considered to be low since an absolute value of the polishing amount is small. Moreover, since a centrifugal force is excessively small, flowage of workpieces and polishing media goes wrong, so that there is a possibility that dents (damage or deformation which is caused on the workpieces by collision resulting from jump of workpieces or polishing media) would occur on the workpieces, with the result that the range is of little practical use. In the range of $6.1(n/N)+40.7<F$, customer needs are considered to be low since the polishing efficiency reduces with increase in the polishing amount and an absolute value of the polishing efficiency is small. Moreover, since a centrifugal force is excessively large, there is a possibility that impressions (damage or deformation which is caused by the pressing of workpieces or polishing media) would occur on the workpieces, with the result that the range is of little practical use. On the other hand, when the relative centrifugal acceleration F is set in the range of $2.1(n/N)+29.5 \leq 6.1(n/N)+40.7$, the polishing efficiency can be maintained while the polishing amount is increased. Further, dents and impressions can be reduced and the running costs can be reduced by the realization of shortening of production time and reduction in the wear of polishing media. Further, the reduction in the dangerous, hard and dirty works and the resolution of global environmental problems can be promoted.

MODE FOR CARRYING OUT THE INVENTION

According to the experiment, the inventors found that luster of workpieces were favorable after polishing when the rotation/revolution ratio n/N is in a range of $-0.45 \leq n/N \leq -0.07$. Accordingly, when the rotation/revolution ratio n/N is set in this range, good polishing resulting in favorable luster can be carried out while trade-off between an increase in the polishing amount and a reduction in the polishing efficiency is resolved.

The barrel may be a regular polygon having five or more sides and may be formed into a hollow polygonal cylindrical shape.

Workpieces and polishing media do not form normal flowage when the barrel is a regular polygon having four or less sides and formed into a hollow polygonal cylindrical shape. When the barrel has a cylindrical shape, the polishing does not proceed since the workpieces and the polishing media slip on an inner peripheral surface of the barrel. On the other hand, when the barrel is a regular polygon having five or more sides and formed into a hollow polygonal cylindrical shape, the workpieces and the polishing media form normal flowage without slippage, with the result that desirable polishing is efficiently carried out.

Four barrels may be disposed to be point-symmetric with respect to a revolution center of the barrels and when a maximum dimension r between the rotation center of each barrel and an inner periphery of each barrel is defined as an imaginary inner radius of each barrel, a ratio R/r may be set in a range of $2<R/r<3$.

In order that off-balance may be avoided in high-speed revolution of the barrels, it is preferred that even-numbered barrels are disposed to be symmetric with respect to a revolution center thereof. And in order that a large total capacity of the point-symmetric even-numbered barrels may be ensured, it is preferable that a dead space at the revolution center surrounded by the even-numbered barrels is rendered as narrow as possible. Further, a plate thickness of each barrel wall needs to be large to some extent in order that each barrel may withstand high-speed rotation. In consideration of these respects, it is preferable that the number of barrels is four and that the ratio of the radius R of orbital path drawn by the rotation center of each barrel to the imaginary inner radius r of each barrel ranges as $2<R/r<3$. When the R/r ratio is thus set, a large total capacity of the barrels can be ensured while a certain level of strength of each barrel is ensured.

Embodiment 1

Figure 1:
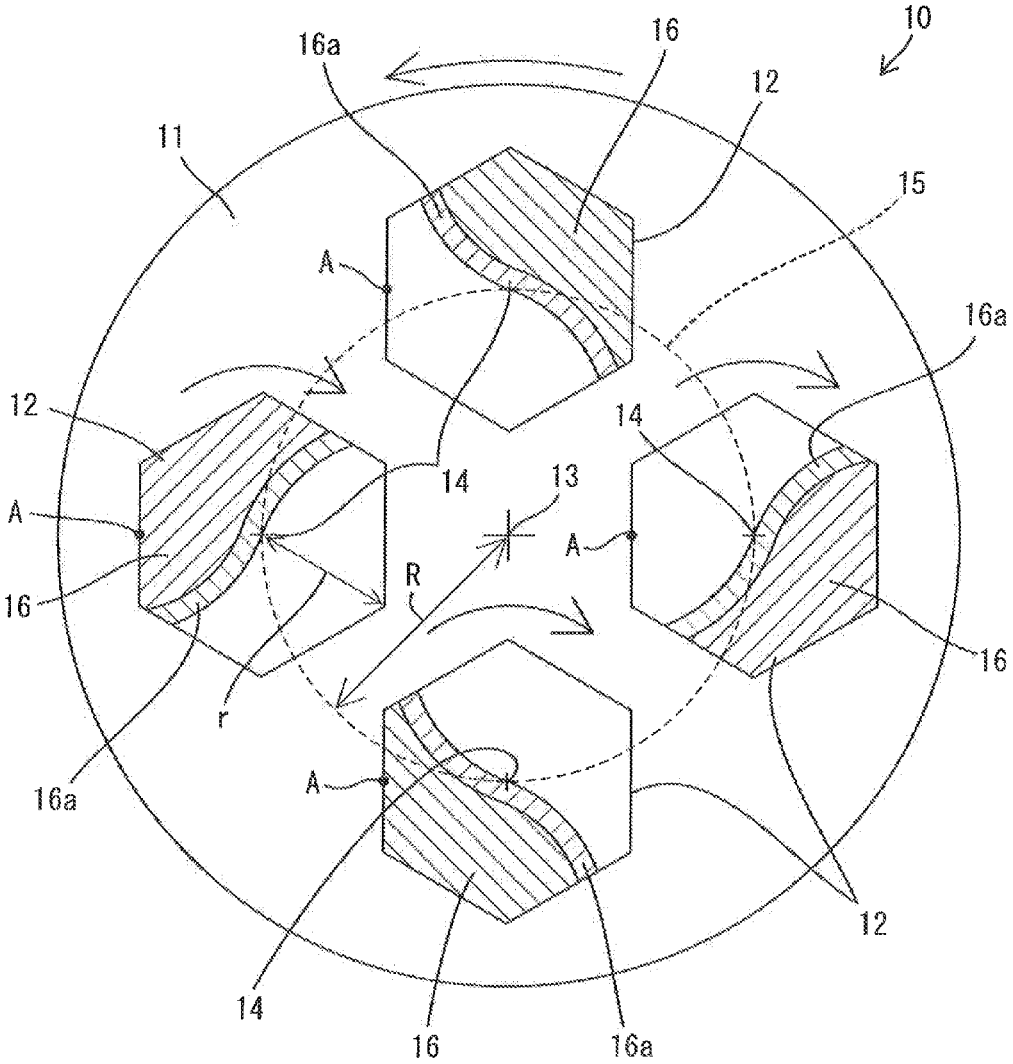
FIG. 1 is a schematic view of a centrifugal barrel polishing machine according to one embodiment.

Embodiment 1 embodying the invention will be described with reference to FIGS. 1 to 3. As shown in FIG. 1, a centrifugal barrel polishing machine 10 of the embodiment includes four barrels 12 which perform planetary rotation and into which mass 16 (workpieces and polishing media) is put, so that the workpieces are polished by the polishing media. The centrifugal barrel polishing machine 10 has means (polishing conditions) which is capable of simultaneously realizing increase in a polishing amount Q (the definition of Q will be described later) and maintenance or improvement of a polishing efficiency E (the definition of E will be described later).

The structure of the centrifugal barrel polishing machine 10 will first be described. The centrifugal barrel polishing machine 10 includes a single rotating plate 11 and four barrels 12. The rotating plate 11 is formed into a circular shape and configured to be rotated at a predetermined speed about a horizontal revolution shaft 13 (a revolution center as a claim component of the invention) in one direction (in the counterclockwise direction in FIG. 1) by a revolution motor which is not shown.

Each barrel 12 is formed into the shape of a regular hexagonal cylindrical shape having six sides as viewed in parallel with a rotation shaft 14 (a rotation center as a claim component in the invention). The four barrels 12 are disposed at respective positions decentered from the revolution shaft 13 of the rotating plate 11 (namely, on circumference of a circle concentric with the revolution shaft 13) circumferentially at regular intervals of 90°. The barrels 12 are configured to be rotated at a predetermined speed about respective rotation shafts 14 parallel to the revolution shaft 13 relative to the rotating plate 11.

A rotative force of the revolution shaft 13 is transmitted to the four barrels 12 via a known rotative force transmitting mechanism which is not shown, so that the four barrels 12 are rotated by the revolution motor serving as a drive source. A rotational direction (a rotation direction) of the barrels 12 is opposed to a rotational direction of the rotating plate 11 (revolution direction) and is clockwise in FIG. 1. Upon drive of the revolution motor, the rotating plate 11 and the barrels 12 are revolved about the revolution shaft 13 together and the barrels 12 are rotated about the respective rotation shafts 14 in the direction opposed to the revolution direction relative to the rotating plate 11, whereby the barrels 12 is rotated in a planetary manner. An orbit drawn by each rotation shaft 14 in the revolution of the barrels 12 is referred to as "orbital path 15."

The following will describe means (polishing conditions) for maintaining or improving a polishing efficiency E while a polishing amount Q of workpieces is increased. The polishing efficiency E is defined as a ratio of a polishing amount Q of workpieces per unit time to a wear amount W of polishing media per unit time. In order to relate the polishing efficiency E and the polishing amount Q of workpieces to structural parameters of the centrifugal barrel polishing machine 10, the inventors focused attention on a relative centrifugal acceleration F that is a ratio of centrifugal acceleration on the orbital path 15 during planetary rotation of the barrels 12 to gravity acceleration g in addition to a conventionally known ratio n/N (rotation/revolution ratio) of rotation speed n (the definition of n will be described in detail later) to revolution speed N (the definition of N will be described in detail later). The inventors conducted an experiment, making a prediction that the relative centrifugal acceleration F and the rotation/revolution ratio n/N had significance in the relationship with a polishing amount and a polishing efficiency.

The inventors made a multiple regression analysis based on the experimental results thereby to derive a regression expression with respect to a polishing amount and a polishing efficiency. The regression expression includes the relative centrifugal acceleration F and the rotation/revolution ratio n/N as explanatory variables. The inventors analyzed the relationship between the relative centrifugal acceleration F and the rotation/revolution ratio n/N both obtained based on the regression expression. Consequently, the inventors found that the relative centrifugal acceleration F, which is suitable to be capable of realizing increasing the polishing amount Q of workpieces per unit time with maintenance or improvement in the polishing efficiency E, is limited to a range of $-2.5(n/N)+12.6 \leq F \leq 6.1(n/N)+40.7$ or more preferably, $2.1(n/N)+29.5 \leq F \leq 6.1(n/N)+40.7$.

A procedure for obtaining a suitable F range will be described in detail. Firstly, TABLE 1 shows symbols used for explanation of the procedure and the definitions of the symbols.

TABLE 1

| Symbol | Definition |
|---|---|
| R | Radius of orbital path of rotation center of barrel (m) |
| r | Imaginary inner radius of barrel (m) |
| N | Revolution speed of barrel per second (rps) |
| n | Rotation speed of barrel per second (rps) |
| v | Peripheral speed of barrel on orbital path (m/s) [$v = 2\pi RN$] |
| g | Gravity acceleration [$g = 9.8\ m/s^2$] |
| F | Relative centrifugal acceleration [$F = v^2/Rg = 4\pi^2N^2R/9.8$] |
| u | Exponential proportionality multiplier of function F of Q [$u = \log_F(Q/\lvert n\rvert)$] |
| t | Exponential proportionality multiplier of function F of W [$t = \log_F(W/\lvert n\rvert)$] |
| Q | Polishing amount per half hour (mg) [$Q = \lvert n\rvert \cdot F^u$] |
| W | Wear amount per half hour (mg) [$W = \lvert n\rvert \cdot F^t$] |
| E | Polishing efficiency per half hour [$E = Q/W = F^{(u-t)}$] |

Symbol "R" designates a radius of the orbital path 15 of the rotation shaft 14 (rotation center) of the barrel 12 in revolution of each barrel 12 in mm. The orbital path 15 is circular and concentric with the revolution shaft 13. Symbol "r" designates an imaginary inner radius of each barrel in mm. The imaginary inner radius is a term created in a nod to that each barrel 12 has a non-circular inner periphery and signifies a maximum dimension between the rotation shaft 14 of each barrel 12 and the inner periphery of each barrel 12. Symbol "N" designates a revolution speed of each barrel 12 per second in rps. Symbol "n" designates a rotation speed of each barrel 12 per second in rps. Symbol "v" designates a circumferential speed of each barrel 12 on the orbital path 15 in m/s. Accordingly, the circumferential speed is represented as $v=2\pi RN$. The foregoing are structural parameters of the centrifugal barrel polishing machine 10.

The following will describe the relationship between the value of a rotation/revolution ratio n/N and a rotational manner of each barrel 12 during polishing. The counterclockwise direction in FIG. 1 is a forward direction regarding the barrels 12. Since the revolution direction of the barrels 12 is a forward direction in the embodiment, the revolution speed N is represented by the symbol "+". Since the rotation direction is a reverse direction, the rotation speed n is represented by the symbol "−". Further, points A are set to left positions of the rotation shafts 14 on the barrels 12, which positions are located on the same level as the rotation shafts 14 of the barrels 12, respectively.

The revolution speed N and the rotation speed n have the same absolute value when $n/N=-1$. Accordingly, each point A maintains a predetermined positional relationship relative to the rotation shaft 14 even when each barrel 12 is located at any position on the orbital path 15. More specifically, the barrels 12 are revolved while retaining constant positions as a Ferris wheel. Further, when $-1<n/N<0$, the absolute value of rotation speed n is smaller than the absolute value of revolution speed N. Accordingly, the barrels 12 change the positions with progress of revolution so as to be rotated in the counterclockwise direction about the rotation shafts 14, respectively.

Symbol "g" designates gravity acceleration, which is represented as $g=9.8\ m/s^2$. Symbol "F" designates relative centrifugal acceleration whose unit is non-dimensional. The relative centrifugal acceleration is a term created to explain the present invention and signifies a ratio of a centrifugal acceleration on the orbital path 15 during rotation of the barrels 12 in the planetary manner to the gravity acceleration g. Accordingly, the relative centrifugal acceleration is represented as $F=v^2/Rg=4\pi^2N^2R/9.8$. Symbol "u" designates an exponential proportionality multiplier of function F of polishing amount Q of workpiece and is represented as $u=\log_F(Q/|n|)$. Symbol "t" designates an exponential proportionality multiplier of function F of wear amount W and is represented as $t=\log_F(W/|n|)$.

Symbol "Q" designates a polishing amount of workpiece per half hour (unit time) in mg and is represented as $Q=|n|\cdot F^u$. Symbol "W" designates a wear amount of polishing media (weight of polishing media chipped away in the polishing) per half hour (unit time) in mg and is represented as $W=|n|\cdot F^t$. Symbol "E" designates a polishing efficiency defined as a ratio of the polishing amount Q of workpiece per half hour (unit time) to the wear amount W of polishing media per half hour (unit time) and is represented as $E=Q/W=F^{(u-t)}$, the unit of which is non-dimensional.

Since the polishing efficiency E is obtained by dividing the polishing amount Q of workpiece by the wear amount W of polishing media, the polishing efficiency E is an index representing a degree of progress in the polishing of workpiece when wear of polishing media has reached a predetermined amount. In other words, the polishing efficiency E is an index representing a degree of suppression in the wear of polishing media when polishing of workpiece has reached a predetermined amount. More specifically, in view of progresses in the polishing of workpiece and wear of polishing media, the polishing efficiency E is an index indicating how efficiently the polishing media contribute to the polishing of workpiece. When compared to automobile, the polishing efficiency E is an index representing good or bad fuel efficiency.

Model formulae of polishing amount Q, wear amount W and polishing efficiency E will be made using the aforementioned symbols as follows. The centrifugal barrel polishing machine 10 performs polishing by applying a centrifugal force caused by revolution to the mass 16 while moving the mass 16 by the rotation of the barrels 12. Accordingly, a significance is considered to be involved in the relationship between the relative centrifugal acceleration F, the polishing amount Q and the polishing efficiency E. More specifically, a polishing amount Q of workpiece is considered to be influenced by flows proportional to the rotation speed n of each barrel 12 and the relative centrifugal acceleration F, so that the polishing amount Q of workpiece can be represented by a model formula including the rotation speed n and the relative centrifugal acceleration F. Further, the relative centrifugal acceleration F needs to be multiplied by an exponential proportional multiplier u in order that the value of polishing amount Q derived from the model formula may correspond to the value of polishing amount Q obtained by an experiment which will be described later. As a result, the polishing amount Q can be represented by an expression 1 (model formula):

$$Q=|n|\cdot F^u \qquad \text{[Expression 1]}$$

Further, the wear amount W of polishing media is also considered to be influenced by flows proportional to the rotation speed n of each barrel 12 and the relative centrifugal acceleration F as the polishing amount Q, so that the wear amount W can be represented by a model formula including the rotation speed n and the relative centrifugal acceleration F. Further, the relative centrifugal acceleration F needs to be multiplied by an exponential proportional multiplier t in order that the value of wear amount W derived from the model formula may correspond to the value of wear amount W obtained by an experiment which will be described later. As a result, the wear amount W can be represented by an expression 2 (model formula):

$$W=|n|\cdot F^t \qquad \text{[Expression 2]}$$

The polishing efficiency E can be represented by an expression 3 (model formula) based on expressions 1 and 2:

$$E=F^{(u-t)} \qquad \text{[Expression 3]}$$

The aforementioned expressions 1, 2 and 3 are model formulae made on the basis of prediction that the relative centrifugal acceleration F has a significance in the relationship with the polishing amount Q and the polishing efficiency E. The exponential proportional multipliers u and t in the model formulae at the prediction step are unknown. If factors influencing the exponential proportional multipliers u and t and a degree of influence can be quantified, this can clarify the relationship between the relative centrifugal acceleration F and the polishing amount Q and the relationship between the relative centrifugal acceleration F and the polishing efficiency E. Consequently, it is considered possible to find the conditions capable of maintaining or improving the polishing efficiency E while the polishing amount Q is improved.

While focusing attention to the relative centrifugal acceleration F as a factor influencing the exponential proportional multiplier u, the inventors made a multiple regression model equation having the exponential proportional multiplier u as an objective variable and the relative centrifugal acceleration F and a square value $F^2$ of the relative centrifugal acceleration as explanatory variables, as shown by expression 4. In the multiple regression model equation, Ua represents a partial regression coefficient of the term having $F^2$ as the explanatory variable, Ub represents a partial regression coefficient of the term having F as the explanatory variable and Uc represents a constant term.

$$u=Ua\cdot F^2+Ub\cdot F+Uc \qquad \text{[Expression 4]}$$

Regarding the exponential proportional multiplier t, too, the inventors focused attention on a relative centrifugal acceleration F and the rotation/revolution ratio n/N as a factor of influence, and also made a multiple regression model equation having the exponential proportional multiplier t as an objective variable and the relative centrifugal acceleration F, a square value $F^2$ of the relative centrifugal acceleration and the rotation/revolution ratio n/N as explanatory variables, as shown by expression 5. In the multiple regression model equation, Ta represents a partial regression coefficient of the term having $F^2$ as the explanatory variable, Tb represents a partial regression coefficient of the term having F as the explanatory variable, Tc represents a partial regression coefficient of the term having n/N as the explanatory variable and Td represents a constant term.

$$t=Ta\cdot F^2+Tb\cdot F+Tc\cdot(n/N)+Td \qquad \text{[Expression 5]}$$

Next, the inventors conducted an experiment on conditions as shown in TABLE 2 to obtain partial regression coefficients Ua, Ub, Uc, Ta, Tb, Tc and Td of the multiple regression model equations as shown by the aforementioned expressions 4 and 5. As shown in TABLE 2, a wet type machine was used as the centrifugal barrel polishing machine 10. In TABLE 2, 20 g of compound was dissolved in 1000 cc of water and was then supplied into the barrels 12. Further, 50% mass 16 means that a ratio of the volume of mass 16 to the volume of each barrel 12 was 50%. The value of rotation/revolution ratio n/N was set in a range of $-1 \leq n/N \leq -0.07$. The reason for this range is as follows.

When n/N>0, the mechanical structure of the centrifugal barrel polishing machine 10 is complicated, resulting in an increase in the production cost. When n/N<−1, luster and glaze are seriously reduced. Further, as shown in FIG. 1, a fluid bed 16*a* is continuously generated on a surface layer of the mass 16 stably in the barrel 12 in rotation, with the result that a favorable polishing is carried out. However, when n/N=0, no fluid bed 16*a* is generated in the barrel 12 with the result that the polishing becomes unexecutable. Accordingly, an experimental range needs to be determined so that the rotation/revolution ratio n/N is set in a range of $-1 \leq n/N < 0$.

Further, when $-0.05 \leq n/N < 0$, no fluid bed 16*a* is generated in the barrel 12 and part of the mass 16 remains so as to be accumulated high, and the accumulated part slumps at once as snow avalanche. These two states are repeated alternately with the result that the polishing effect becomes unstable and the polishing amount Q becomes extremely small. Accordingly, the range of $-0.05 \leq n/N < 0$ lacks marketability. Moreover, it is also difficult to accurately measure a minute polishing amount Q and a minute wear amount W. As a result, a suitable practical range of the rotation/revolution ratio n/N is represented as $-1 \leq n/N < -0.05$, within which range the experimental condition of the rotation/revolution ratio n/N is set.

Further, when the relative centrifugal acceleration F is roughly not more than 9, a force pressing the fluid bed 16*a* against an inner surface side of each barrel 12 is insufficient, whereupon part of the mass 16 floats on the surface layer of the fluid bed 16*a* thereby to increase the risk of dents (damage or deformation which is caused in the workpieces by collision resulting from jump of workpieces or polishing media). Further, when the relative centrifugal acceleration F is roughly more than 45, the mass 16 is excessively pressed thereby to increase the risk of impressions (damage or deformation which is caused by the pressing of workpieces or polishing media). Accordingly, a practical range of the relative acceleration F is roughly represented as 9<F<45, within which range the experimental condition of the relative centrifugal acceleration F is set. Further, low-abrasion ceramic polishing media are employed as an experimental condition. The ceramic polishing media are used more widely than resin polishing media and metal media in the markets.

TABLE 2

| | |
|---|---|
| Centrifugal barrel Polishing machine | wet type |
| Compound | 20 g |
| Water | 1000 cc |
| Workpiece (experimental piece) | drive component (chain plate) |
| Mass volume | 50% |
| R | 0.21 m |
| r | 0.1 m |
| Barrel type | hexagonal prism (regular hexagonal cylindrical shape); volume 3.4 L |
| Polishing media | ceramic balls |
| N | $3.333 \leq N \leq 7.167$ |
| n | $-3.333 \leq n \leq -0.500$ |
| n/N | $-1 \leq n/N \leq -0.07$ |
| F | $9.40 \leq F \leq 43.45$ |

TABLE 3 shows results of the experiment conducted under these conditions and values calculated based on the experimental conditions. In TABLE 3, the revolution speed N of each barrel 12 and the rotation speed n of each barrel 12 are condition values serving as the experimental conditions. The rotation/revolution ratio n/N is a condition value calculated based on the revolution speed N and the rotation speed n. The relative centrifugal acceleration F is a condition value calculated by substituting the revolution speed N and the value of radius R of orbital path 15 of the barrel 12 into the equation shown in TABLE 1. The polishing amount Q of workpiece (experimental piece) and the wear amount W of polishing media are experimental values obtained as the experimental results. The polishing efficiency E is an experimental value obtained from the equation E=Q/W as shown in TABLE 1 based on the polishing amount Q obtained by the experiment and the wear amount W obtained by the experiment.

TABLE 3

| No. | N | n | n/N | F | Q | W | E |
|---|---|---|---|---|---|---|---|
| 1 | 7.167 | −0.500 | −0.070 | 43.450 | 1255 | 66469 | 0.0189 |
| 2 | 7.167 | −1.500 | −0.209 | 43.450 | 3026 | 211005 | 0.0143 |
| 3 | 7.167 | −2.500 | −0.349 | 43.450 | 4945 | 374542 | 0.0132 |
| 4 | 7.167 | −3.333 | −0.465 | 43.450 | 7814 | 672944 | 0.0116 |
| 5 | 6.667 | −0.500 | −0.075 | 37.598 | 608 | 22350 | 0.0272 |
| 6 | 6.667 | −1.500 | −0.225 | 37.598 | 2065 | 91770 | 0.0225 |
| 7 | 6.667 | −2.500 | −0.375 | 37.598 | 3353 | 163530 | 0.0205 |
| 8 | 6.667 | −3.333 | −0.500 | 37.598 | 4273 | 217650 | 0.0196 |
| 9 | 5.000 | −0.500 | −0.100 | 21.149 | 318 | 10590 | 0.0300 |
| 10 | 5.000 | −1.500 | −0.300 | 21.149 | 1005 | 45870 | 0.0219 |
| 11 | 5.000 | −2.500 | −0.500 | 21.149 | 1807 | 96480 | 0.0187 |
| 12 | 5.000 | −3.333 | −0.667 | 21.149 | 2437 | 141180 | 0.0173 |
| 13 | 3.333 | −0.500 | −0.150 | 9.400 | 138 | 6122 | 0.0225 |
| 14 | 3.333 | −1.500 | −0.450 | 9.400 | 422 | 18810 | 0.0224 |
| 15 | 3.333 | −2.500 | −0.750 | 9.400 | 673 | 39990 | 0.0168 |
| 16 | 3.333 | −3.333 | −1.000 | 9.400 | 974 | 69420 | 0.0140 |

| No. | u | t | luster |
|---|---|---|---|
| 1 | 2.075 | 3.128 | ◎ |
| 2 | 2.018 | 3.143 | ◎ |
| 3 | 2.012 | 3.160 | ◎ |
| 4 | 2.057 | 3.239 | ○ |
| 5 | 1.958 | 2.952 | ◎ |
| 6 | 1.993 | 3.039 | ◎ |
| 7 | 1.985 | 3.057 | ◎ |
| 8 | 1.973 | 3.057 | ○ |
| 9 | 2.115 | 3.264 | ◎ |
| 10 | 2.132 | 3.384 | ◎ |
| 11 | 2.157 | 3.461 | ○ |
| 12 | 2.161 | 3.491 | ○ |
| 13 | 2.508 | 4.201 | ◎ |
| 14 | 2.517 | 4.212 | ◎ |
| 15 | 2.497 | 4.320 | ○ |
| 16 | 2.534 | 4.438 | ○ |

where symbol ◎ designates "good" and symbol ○ designates "average."

The inventors performed a multiple regression analysis using a least square method, based on the condition values and experimental values shown in TABLE 3 and expressions 1, and 3 to 5 thereby to obtain the partial regression coefficients Ua, Ub, Uc, Ta, Tb, Tc and Td of the multiple regression model equations shown in expressions 4 and 5. Consequently, multiple regression equations shown as expressions 6 and 7 were obtained. Contribution ratios of the multiple regression equations are not less than 0.9, whereupon each of the multiple regression equations is a model equation having high reproducibility.

$$u=0.0008144F^2-0.057121F+2.9806396 \quad \text{[Expression 6]}$$

$$t=0.0018531F^2-0.128522F-0.301244(n/N)+5.163181 \quad \text{[Expression 7]}$$

Figure 2:
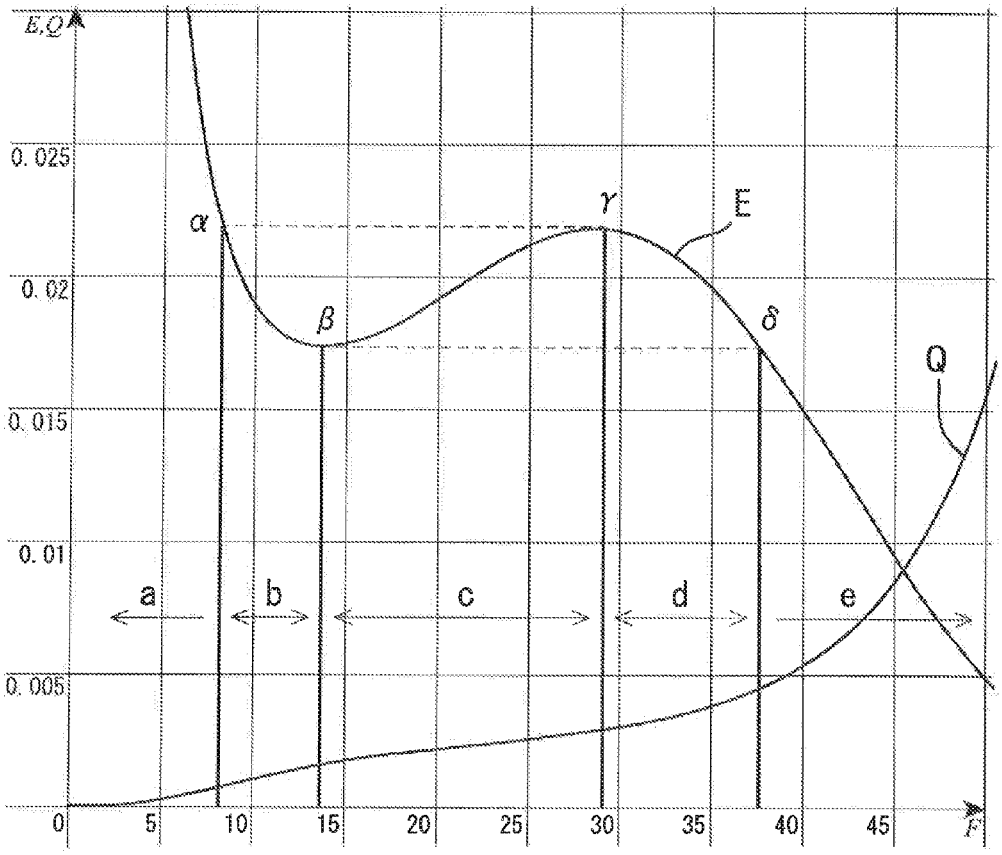
FIG. 2 is a graph having a vertical axis representing a polishing amount Q and a polishing efficiency E and a horizontal axis representing a relative centrifugal acceleration F.
Figure 3:
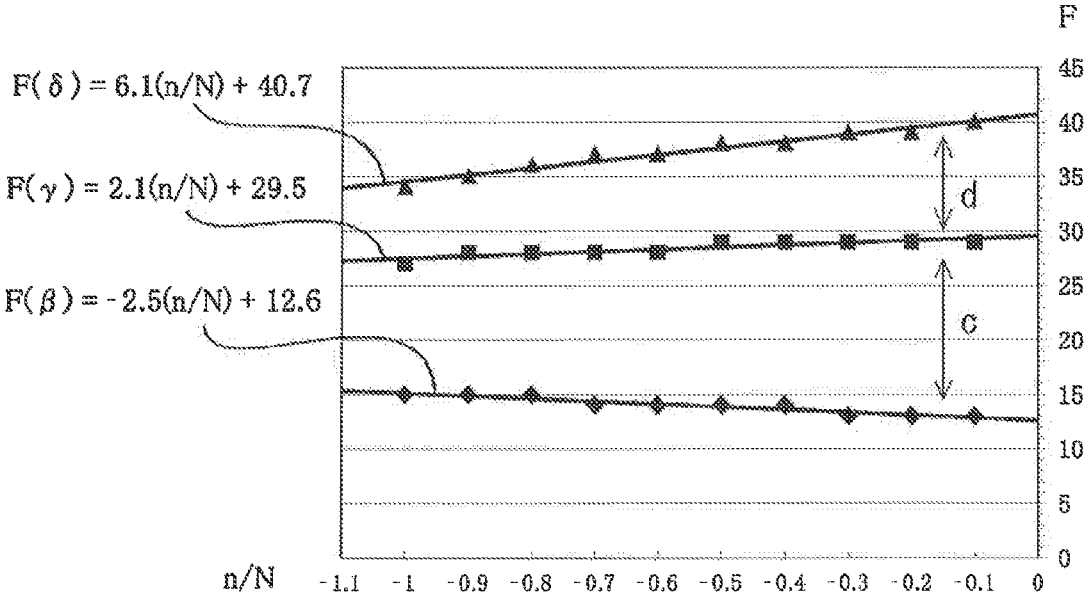
FIG. 3 is a graph having a vertical axis representing relative centrifugal accelerations F(β), F(γ) and F(δ) at flexion point β, flexion point γ and transient point δ respectively and a horizontal axis representing a rotation/revolution ratio n/N.

FIG. 2 is a graph having a vertical axis denoting the polishing amount Q and the polishing efficiency E and a horizontal axis denoting the relative centrifugal acceleration F, based on the expressions 1 and 3 and the multiple regression equations of expressions 6 and 7, in the case where "−3.3" is substituted into n of the expression representing the polishing amount Q of expression 1 and "−0.5" is substituted into n/N of the expression representing the polishing efficiency E of expression 3. Note that the unit of the polishing amount Q in the graph of FIG. 2 has been changed from mg to kg.

The following can be understood from the graph. With increase in the relative centrifugal acceleration F, the polishing amount Q of workpieces is increased but the polishing efficiency generally tends to be reduced. However, the value of the polishing efficiency E is maintained at a high level only when the relative centrifugal acceleration F is in the ranges c and d.

The value of the relative centrifugal acceleration F in the regions c and d is in a range of $-2.5(n/N)+12.6 \leq F \leq 6.1(n/N)+40.7$.

Further, the value of the relative centrifugal acceleration F in the region d is in a range of $2.1(n/N)+29.5 \leq F \leq 6.1(n/N)+40.7$ The region c ranges from a flexion point β ($F=-2.5(n/N)+12.6$) at which the polishing efficiency E having been reduced is increased with the increase in the relative centrifugal acceleration F to a flexion point γ ($F=2.1(n/N)+29.5$) at which the polishing efficiency E is reduced again. The flexion points β and the values of the polishing efficiency E at the flexion points β have technical significance in the sense that the change of the polishing efficiency E changes from the reduction to the increase. When an overall range from the region a to the region e is viewed, the polishing efficiency E is reduced with increase in the polishing amount Q. On the other hand, both the polishing amount Q and the polishing efficiency E are increased with increase in the relative centrifugal acceleration F in the region c, and the value of the polishing efficiency E is maintained at a high level. Accordingly, the region c is a special region (a disparate region in that trade-off between the increase in the polishing amount Q and the reduction in the polishing efficiency E has been resolved).

Further, the region d ranges from the flexion point γ at which the polishing efficiency E having been increased is reduced to a transient point δ ($F=6.1(n/N)+40.7$) at which the polishing efficiency E is reduced to the same value as at the flexion point β. When an overall range from the region a to the region e is viewed, the polishing efficiency E is reduced with increase in the polishing amount Q. On the other hand, the polishing amount Q is increased with increase in the relative centrifugal acceleration F in the region d, and the value of the polishing efficiency E having been reduced to the flexion point β is maintained at a higher level than at the flexion point β. Accordingly, the region d is a disparate region in that trade-off between the increase in the polishing amount Q and the reduction in the polishing efficiency E has been resolved.

Further, the region b where the relative centrifugal acceleration F is smaller than in the region c ranges from a transient point α where the polishing efficiency E is the same as at the flexion point γ to the flexion point β. In the region b, the value of the polishing efficiency E is at a high level as in the regions c and d. However, since the region b is a transit region in the course of the reduction in the polishing efficiency E in the overall range from region a to region e, the region b is not a special region. Moreover, the polishing amount Q in the region b is lower than in the regions c and d.

Further, in the region a where the relative centrifugal acceleration F is smaller than in the region b, the polishing efficiency E is higher than in the regions c and d but the polishing amount Q is seriously small, with the result that the region a is not a good region. Moreover, when $-1 \leq n/N < -0.05$, the value of relative centrifugal acceleration F at a transient point a ranges from 7 to 10. As a result, in the region a where the relative centrifugal acceleration F is smaller than at the transient point α, a force pressing the fluid bed 16*a* against the inner surface of each barrel 12 is insufficient. As a result, the region a has a high risk of disturbance of the fluid bed 16*a* on the surface layer with the result of occurrence of dents on the workpieces. Accordingly, the region a still lacks practical utility and versatility. Further, the polishing efficiency E is seriously reduced with increase in the polishing amount Q, and the trade-off between the increase in the polishing amount Q and the reduction in the polishing efficiency E cannot be resolved. Thus, the region a is not a disparate region.

Further, in the region e where the relative centrifugal acceleration F is larger than in the region d, the polishing efficiency E is extremely low though the polishing amount Q is large. Accordingly, the region e is not a good region. Moreover, when $-1 \leq n/N < -0.05$, the relative centrifugal acceleration F at the transient point δ ranges from 34 to 40. The region e in which the relative centrifugal acceleration F is larger than at the transient point δ has a high risk of occurrence of impressions on the workpieces. Thus, the region e still lacks practical utility and versatility. Further, the polishing efficiency E is seriously reduced with increase in the polishing amount Q, and the trade-off between the increase in the polishing amount Q and the reduction in the polishing efficiency E cannot be resolved. Thus, the region e is not a disparate region.

To summarize the foregoing, the practical range of the relative centrifugal acceleration F includes the region b, the region c and the region d. Each of the regions a and e has extremely small (low) polishing amount Q or polishing efficiency E and a high risk of occurrence of dents or impressions on the workpieces. Accordingly, each of the regions a and e is an inferior range. With increase in the relative centrifugal acceleration F, the polishing amount Q is generally increased and the polishing efficiency E is generally reduced. Only in the regions c and d, however, the polishing amount Q is improved and the polishing efficiency E is maintained or improved with increase in the relative centrifugal acceleration F.

Further, the value of relative centrifugal acceleration F defining the ranges of regions c and d varies according to the value of rotation/revolution ratio n/N. In the graph of FIG. 3, the vertical axis denotes the relative centrifugal acceleration F and the horizontal axis denotes the rotation/revolution ratio n/N, based on the expression 3 and the multiple regression equation of expressions 6 and 7. The relative centrifugal accelerations F(β), F(γ) and F(δ) at respective flexion point β, flexion point γ and transient point δ are plotted.

According to the graph, the relative centrifugal acceleration F(β) at flexion point β becomes smaller as the rotation/revolution ratio n/N becomes large (the absolute value becomes small). The relative centrifugal accelerations F(γ) and F(δ) at the respective flexion and transient points γ and δ become larger as the rotation/revolution ratio n/N becomes large (the absolute value becomes small). Further, the ranges of the regions c and d are enlarged as the value of the rotation/revolution ratio n/N becomes large. TABLE 4 schematically represents the relationship of the relative centrifugal accelerations F(β), F(γ) and F(δ) at the respective flexion point β, flexion point γ and transient point δ with the rotation/revolution ratio n/N.

TABLE 4

| | F | | | | |
|---|---|---|---|---|---|
| | c | | d | | |
| n/N | β | ~ | γ | ~ | δ |
| −0.1 | 13 | ~ | 29 | ~ | 40 |
| −0.2 | 13 | ~ | 29 | ~ | 39 |
| −0.3 | 13 | ~ | 29 | ~ | 39 |
| −0.4 | 14 | ~ | 29 | ~ | 38 |
| −0.5 | 14 | ~ | 29 | ~ | 38 |
| −0.6 | 14 | ~ | 28 | ~ | 37 |
| −0.7 | 14 | ~ | 28 | ~ | 37 |
| −0.8 | 15 | ~ | 28 | ~ | 36 |
| −0.9 | 15 | ~ | 28 | ~ | 35 |
| −1 | 15 | ~ | 27 | ~ | 34 |

As described above, the inventors focused attention on the rotation/revolution ratio n/N (ratio of rotation speed n of each barrel 12 to the revolution speed N) and the relative centrifugal acceleration F which is a ratio of the centrifugal acceleration on the orbital path 15 during the planetary rotation of the barrel 12 to the gravity acceleration, as the means for improving the polishing amount Q and simultaneously maintaining or improving the polishing efficiency E, that is, as the means for resolving trade-off between the increase in the polishing amount Q and the reduction in the polishing efficiency E. The inventors found that the relative centrifugal acceleration F during planetary rotation of each barrel 12 should have been set in a range represented by the following expression:

$$2.5(n/N)+12.6 \leq F \leq 6.1(n/N)+40.7$$

In the range of $F<-2.5\ (n/N)+12.6$ (regions a and b in FIG. 2), the polishing amount Q is extremely low in the region a and low in the region b although the polishing efficiency E is high. Moreover, since the centrifugal force is excessively small in the region a, the region a has a high risk of disturbance in the flowage of the workpieces and the polishing media with the result of occurrence of dents on the workpieces. Accordingly, the region a lacks practical utility. In the range of $6.1(n/N)+40.7<F$ (region e in FIG. 2), the polishing efficiency E is low although the polishing amount Q is large. Moreover, since the centrifugal force is excessively large, there is a possibility of occurrence of impressions on the workpieces. Accordingly, the region e lacks practical utility.

On the other hand, when the relative centrifugal acceleration F is set in a range of $-2.5(n/N)+12.6 \leq F \leq 6.1(n/N)+40.7$ (regions c and d in FIG. 2), the polishing efficiency E can be maintained or increased while the polishing amount Q is increased. Accordingly, the wear amount W per polishing amount Q can be reduced while the polishing amount Q is increased. Thus, shortening of production time and reduction in the wear of the polishing media can be realized by simultaneous improvement of both polishing amount Q and polishing efficiency E, whereupon the running costs can be reduced. Further, the dangerous, hard and dirty works can be reduced and the resolution of the global environmental problems can be promoted.

Further, when the relative centrifugal acceleration F is set in a range of $2.1(n/N)+29.5 \leq F \leq 6.1(n/N)+40.7$, the polishing amount Q is increased as compared with the case of $-2.5(n/N)+12.6 \leq F < 2.1(n/N)+29.5$, although the polishing efficiency E is substantially the same. Accordingly, the range of $2.1(n/N)+29.5 \leq F \leq 6.1(n/N)+40.7$ is superior in the productivity.

Further, the inventors have found from the experiment that luster of workpieces after the polishing is good when the rotation/revolution ratio n/N during the planetary rotation of the barrel 12 is in the range of $-0.45 \leq n/N \leq -0.07$. Accordingly, when the rotation/revolution ratio n/N is set in the range, good quality polishing which provides good luster can be carried out while the trade-off between increase in the polishing amount Q of workpieces and reduction in the polishing efficiency E is resolved.

Further, the workpieces and polishing media do not form normal flowage when each barrel is a regular polygon having four or less sides and formed into a hollow polygonal cylindrical shape. When the barrel has a cylindrical shape, the polishing does not proceed since the workpieces and the polishing media slip on an inner peripheral surface of the barrel. On the other hand, the barrel 12 of the embodiment is a regular polygon having six sides (that is, five or more sides) and formed into a hollow polygonal cylindrical shape. Accordingly, the workpieces and the polishing media form normal flowage without slippage, with the result that desirable polishing is efficiently carried out.

Further, in order that off-balance may be avoided in high-speed revolution of the barrels, it is preferred that even-numbered barrels are disposed to be symmetric with respect to a revolution center thereof. And in order that a large total capacity of the point-symmetric even-numbered barrels may be ensured, it is preferable that a dead space at the revolution center surrounded by the even-numbered barrels is rendered as narrow as possible. Further, a plate thickness of each barrel wall needs to be large to some extent in order that each barrel may withstand high-speed rotation.

In consideration of these respects, in the embodiment, the number of barrels 12 is four and the ratio of the radius R of the orbital path 15 drawn by the rotation center of each barrel 12 to the imaginary inner radius r of each barrel 12 ranges as $2<R/r<3$. The imaginary inner radius r is a maximum dimension between the rotation center and the inner periphery of each barrel 12, that is to say, a circumradius of each barrel 12 with the plate thickness thereof being ignored. When the R/r ratio is thus set, a large total capacity of the barrels 12 can be ensured while a certain level of strength of each barrel 12 is ensured.

Other Embodiments

The invention should not be limited to the embodiment described above with reference to the drawings. For example, the technical range of the invention encompasses the following embodiments.

(1) Although each barrel is a regular hexagon and is formed into a hollow polygonal cylindrical shape in the foregoing embodiment, each barrel may be a regular polygon having five or less sides and may be formed into a hollow polygonal cylindrical shape, or each barrel may be a regular polygon having seven or more sides and may be formed into a hollow polygonal cylindrical shape or a circularly cylindrical shape.

(2) Although the four barrels are provided in the foregoing embodiment, three or less barrels or five or more barrels may be provided.

(3) In the foregoing embodiment, the ratio of the radius R of the orbital path of the rotation center of each barrel to the imaginary inner radius r (the maximum dimension between the rotation center of each barrel and the inner peripheral surface) of each barrel is set to the range of $2<R/r<3$. However, the ratio R/r may be set to $R/r \leq 2$ or $3 \leq R/r$.

(4) In the foregoing embodiment, a plurality of barrels is arranged on the same circumference in an equiangular manner (an equiangular pitch), whereby the gravity centers of the barrels are located on the revolution shaft so that the gravity centers are stably balanced during revolution. However, a plurality of barrels may be disposed on the same circumference in a non-equiangular manner (a non-equiangular pitch). In this case, when balancers are provided so as to be revolved together with the barrels respectively, balance of gravity centers during revolution can be stabilized.

(5) In the foregoing embodiment, a plurality of barrels is disposed so as to be point-symmetric with respect to the revolution shaft, whereby the balance of gravity centers of the barrels is stabilized. However, when a single barrel is provided, a balancer revolved together with the barrel is provided at a point-symmetric position of the barrel, with the result that the gravity center balance during the revolution can be stabilized.

EXPLANATION OF REFERENCE SYMBOLS

10 . . . centrifugal barrel polishing machine
12 . . . barrel
13 . . . revolution axis (revolution center)
14 . . . rotation axis (rotation center)
15 . . . orbital path

The invention claimed is:

1. A centrifugal barrel polishing machine which includes a barrel which is configured to perform planetary rotation and into which workpieces and ceramic polishing media are put, thereby polishing the workpieces by the polishing media, wherein a relative centrifugal acceleration F during the planetary rotation of the barrel is set in a range of $2.1(n/N)+29.5 \leq F \leq 6.1(n/N)+40.7$ where N designates a revolution speed of the barrel, n designates a rotation speed of the barrel, R designates a radius of an orbital path drawn by a rotation center of the barrel, n/N designates a rotation/revolution ratio of the barrel, and $F=4\pi^2N^2R/g$ designates a relative centrifugal acceleration which is a ratio of a centrifugal acceleration on the orbital path during the planetary rotation of the barrel to gravity acceleration g.

2. The centrifugal barrel polishing machine according to claim 1, wherein the rotation/revolution ratio n/N during the planetary rotation of the barrel is set in a range of $-0.45 \leq n/N \leq -0.07$.

3. The centrifugal barrel polishing machine according to claim 1, wherein the barrel is a regular polygon having five or more sides and is formed into a hollow polygonal cylindrical shape.

4. The centrifugal barrel polishing machine according to claim 1, wherein four barrels are disposed to be point-symmetric with respect to a revolution center of the barrels and when a maximum dimension r between the rotation center of each barrel and an inner periphery of each barrel is defined as an imaginary inner radius of each barrel, a ratio R/r is set in a range of $2<R/r<3$.

5. A centrifugal barrel polishing method of polishing workpieces by ceramic polishing media by putting the workpieces and the polishing media into a barrel which perform planetary rotation, wherein a relative centrifugal acceleration F during the planetary rotation of the barrel is set in a range of $2.1(n/N)+29.5 \leq F \leq 6.1(n/N)+40.7$ where N designates a revolution speed of the barrel, n designates a rotation speed of the barrel, R designates a radius of an orbital path drawn by a rotation center of the barrel, n/N designates a rotation/revolution ratio of the barrel, and $F=4\pi^2N^2R/g$ designates a relative centrifugal acceleration which is a ratio of a centrifugal acceleration on the orbital path during the planetary rotation of the barrel to gravity acceleration g.

* * * * *